United States Patent [19]

Ovadia et al.

[11] Patent Number: 4,767,000

[45] Date of Patent: Aug. 30, 1988

[54] JEWELRY DISPLAY AND PACKAGING BOX AND BLANK THEREFOR

[75] Inventors: Abraham Ovadia, Little Falls, N.J.; Howard I. Finelt, New City, N.Y.

[73] Assignee: Ovadia Corporation, Little Falls, N.J.

[21] Appl. No.: 76,319

[22] Filed: Jul. 22, 1987

[51] Int. Cl.[4] ..... B65D 25/02; B65D 65/12; B65D 65/24

[52] U.S. Cl. ..... 206/45.14; 206/566

[58] Field of Search ..... 206/45.14, 566

[56] References Cited

U.S. PATENT DOCUMENTS

| | | | |
|---|---|---|---|
| 1,231,674 | 7/1917 | Underwood | 206/566 X |
| 1,352,759 | 9/1920 | Markert | 206/45.19 |
| 1,944,714 | 1/1934 | Lehmann | 206/45.14 |
| 2,327,301 | 8/1943 | Davis | 206/45.14 |
| 2,739,697 | 3/1956 | Kuddes | 206/566 X |
| 2,797,806 | 7/1957 | Davis | 206/566 X |
| 4,552,264 | 11/1985 | Quarrell et al. | 206/566 X |

FOREIGN PATENT DOCUMENTS

| | | | |
|---|---|---|---|
| 2258811 | 8/1975 | France | 206/566 |

*Primary Examiner*—William Price

*Attorney, Agent, or Firm*—Peter L. Berger

[57] ABSTRACT

A display and packaging box formed from a blank includes a bottom wall; first and second end walls extending upward from the bottom wall and defining with the bottom wall an upwardly open container, each end wall having an upper edge; a cover flap pivotally connected to one of the upper edges for movement between a closed position in covering relation to the open container and an open position to permit access to the open container; a display flap pivotally connected to the other of the upper edges for movement between a display position extending above the cover flap when the latter is in the closed position and a packaging position between the bottom wall and the cover flap; the display flap including mounting formations for securely mounting an object thereto such that the object is displayed when the display flap is in the display position and is safely contained in the box when the display flap is in the packaging position; side walls pivotally connected with the end walls for maintaining the display flap in the display position; and two securing flaps connected to the bottom wall for releasably locking the cover flap in the closed positon when the display flap is in the packaging position so as to package the object in the box for transport and for releasably locking the cover flap in the closed position when the display flap is in the display position to display the object.

22 Claims, 10 Drawing Sheets

FIG. 1
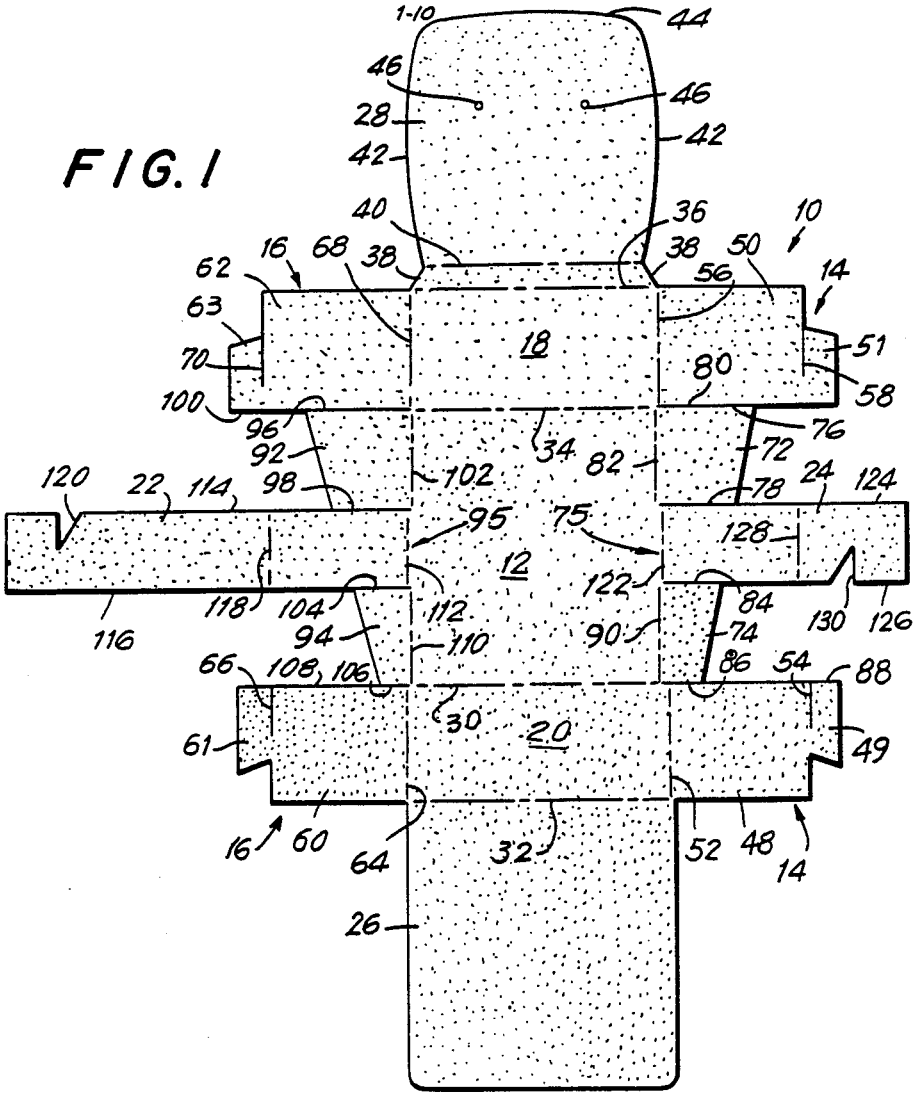
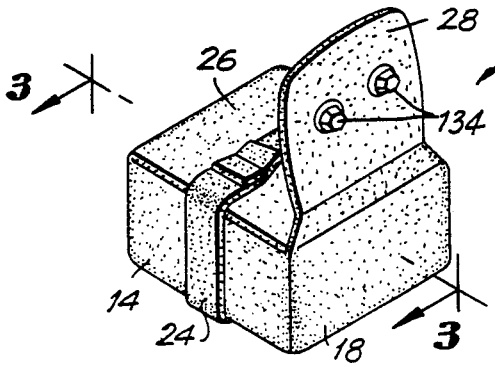
FIG. 2

FIG. 3
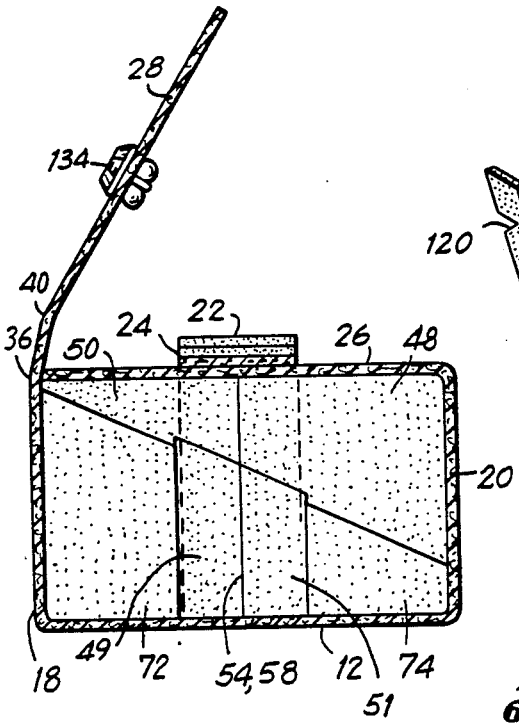
FIG. 4
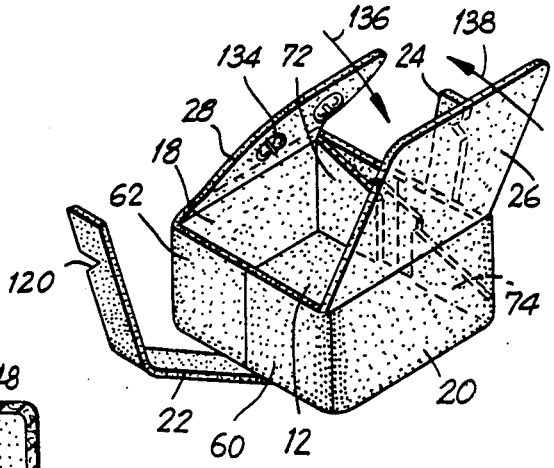
FIG. 5
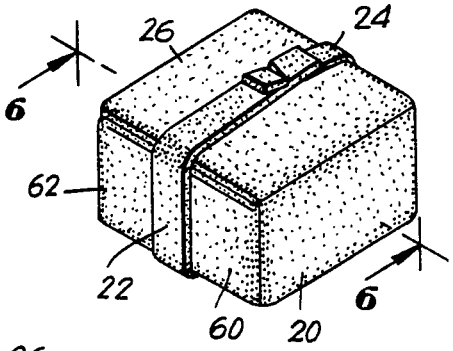
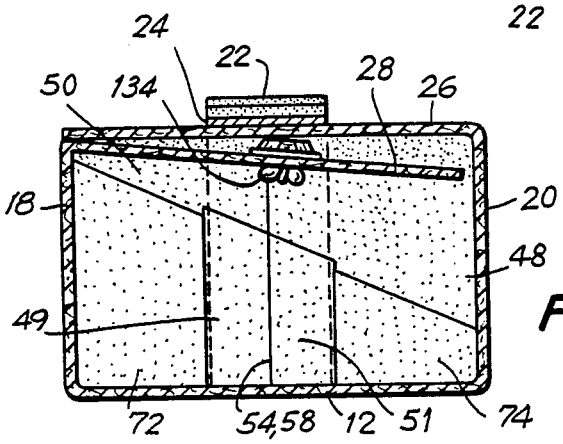
FIG. 6

FIG. 7
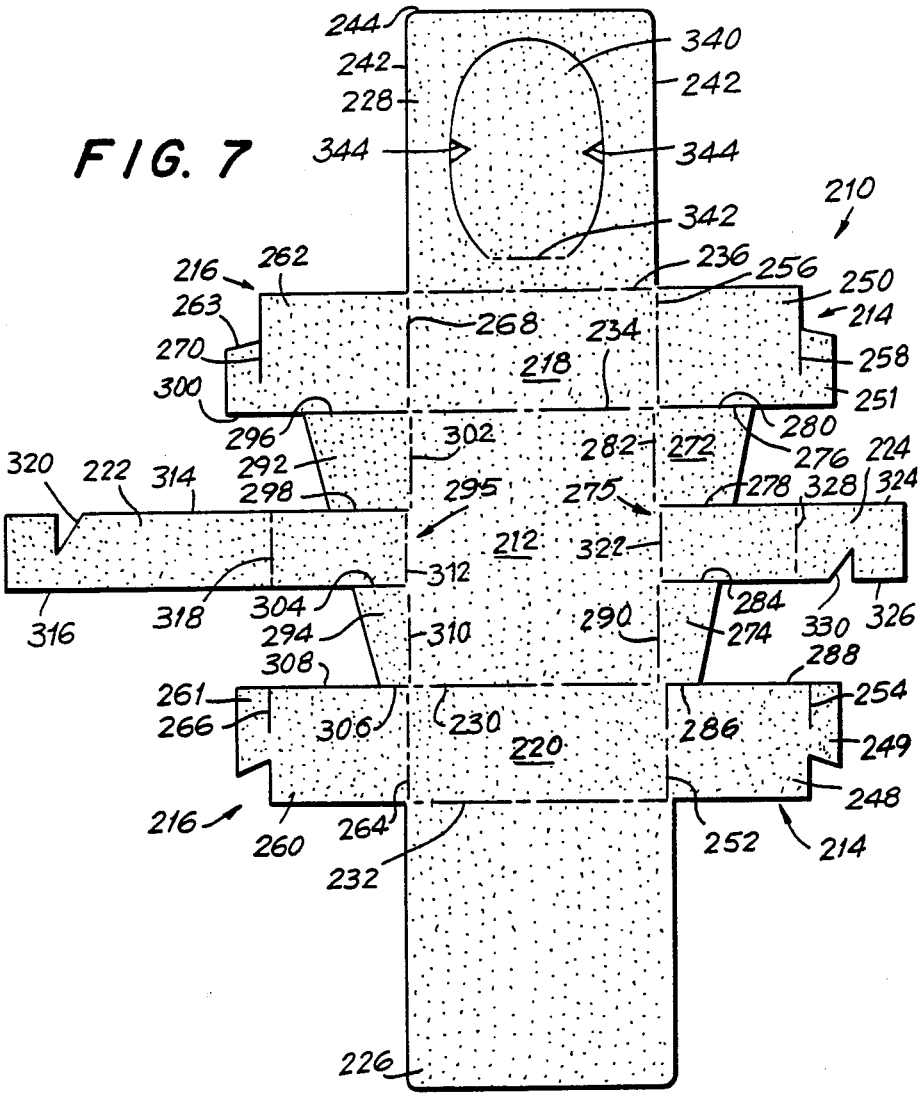
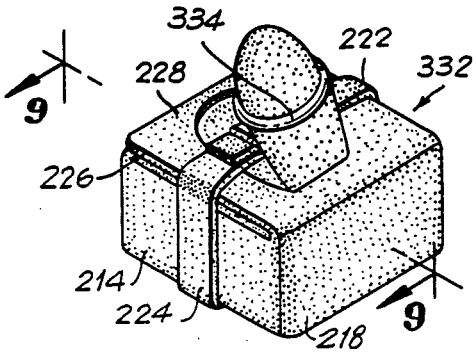
FIG. 8

FIG. 9
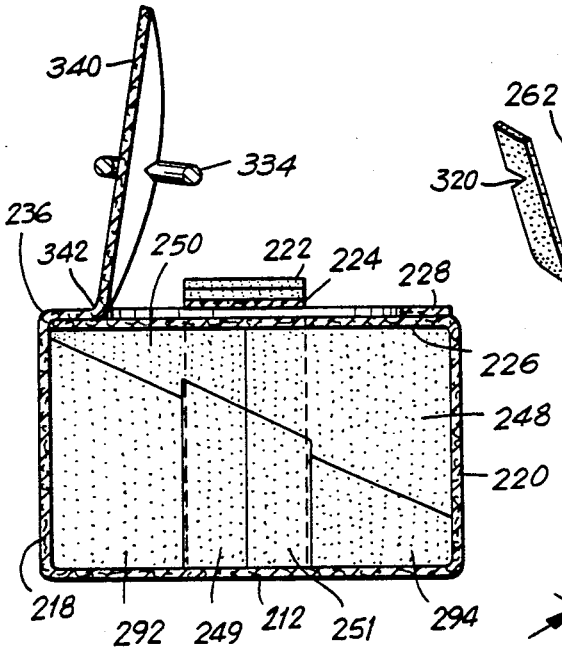
FIG. 10
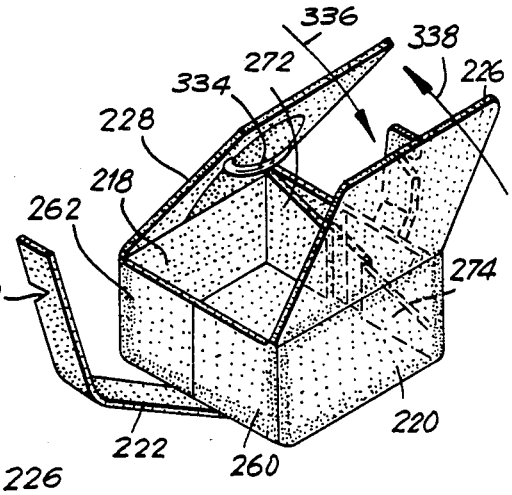
FIG. 11
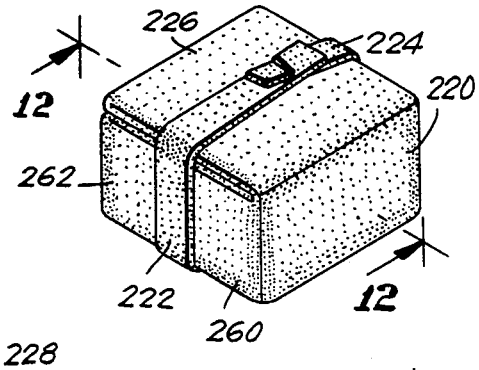
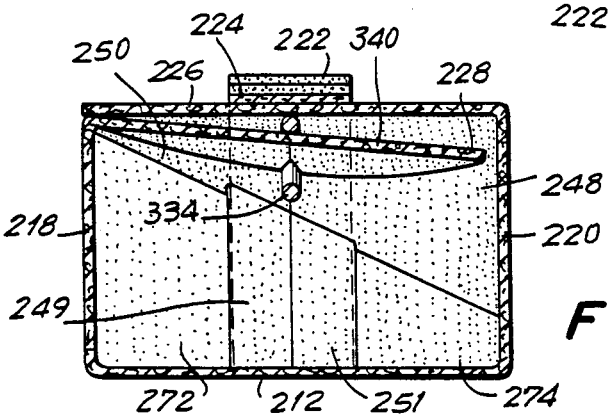
FIG. 12

428
534
535
532
436
418
434
412
460
463
461
462
420
422
424
426
520
530
448
451
449
450
A
B
C
D
19
419

FIG. 20
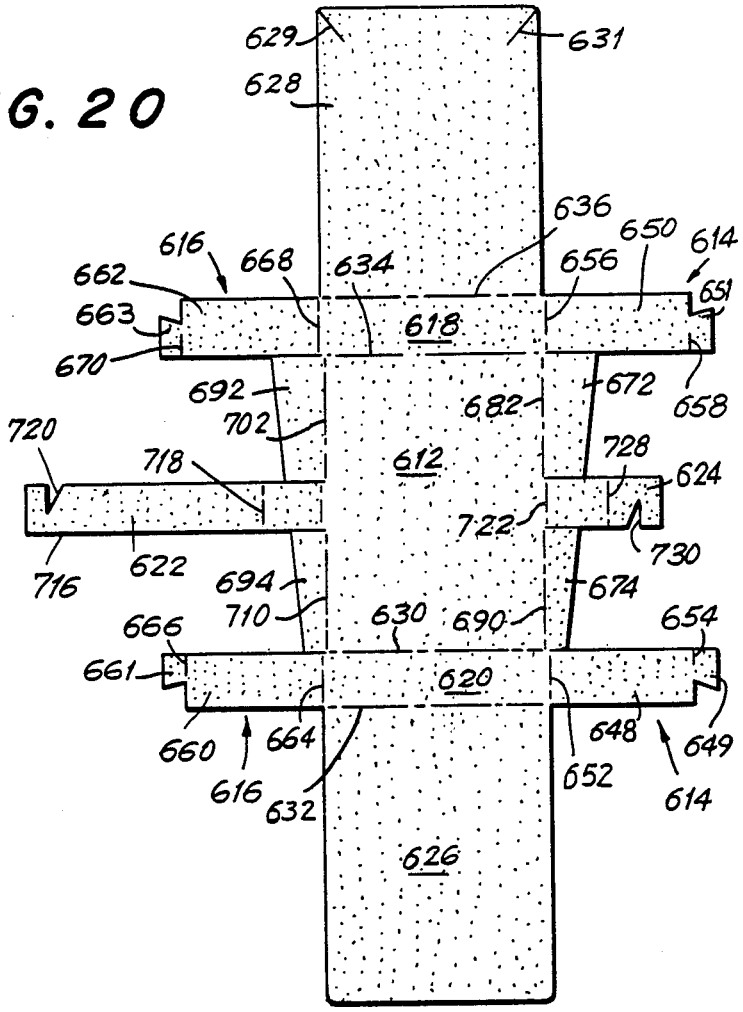
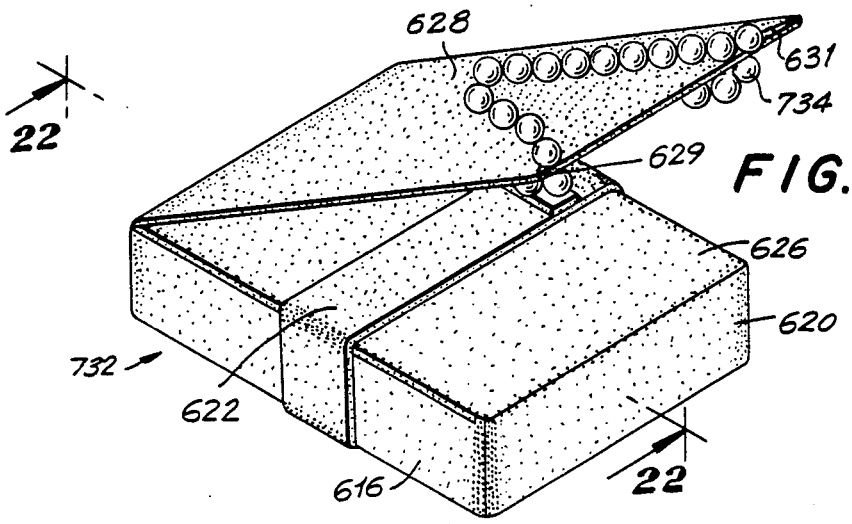
FIG. 21

FIG. 22
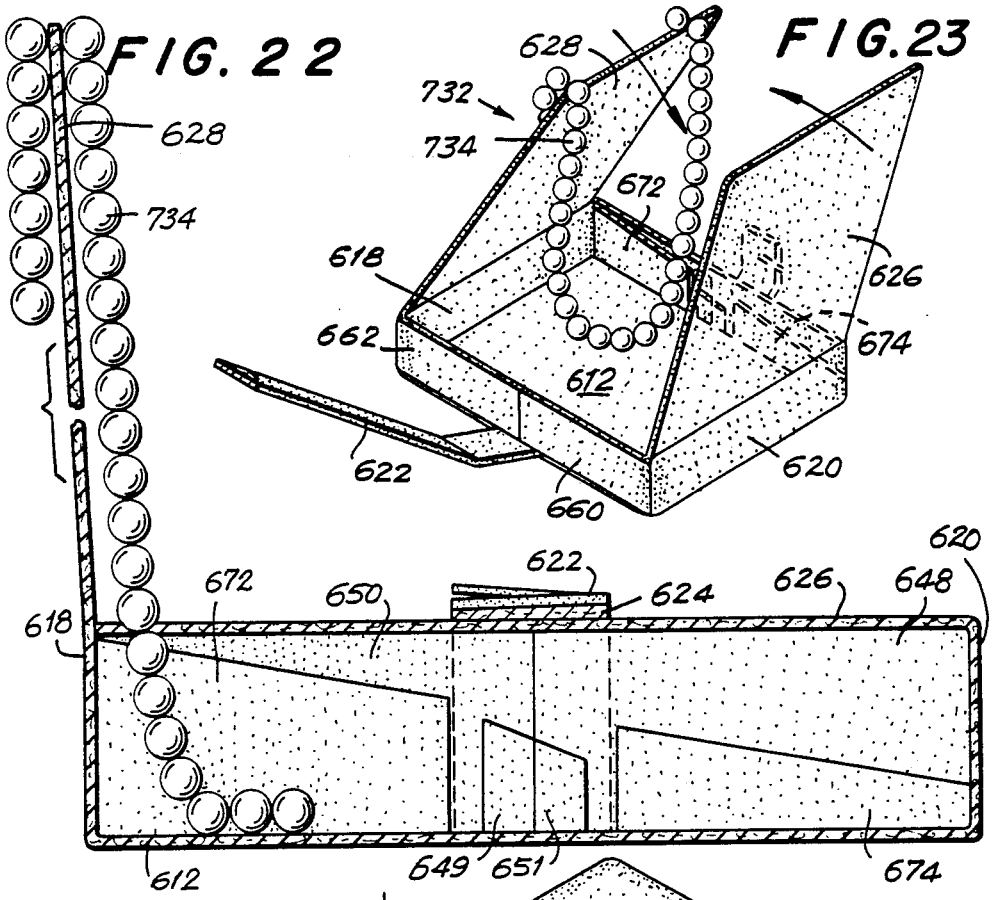
FIG. 23
FIG. 24
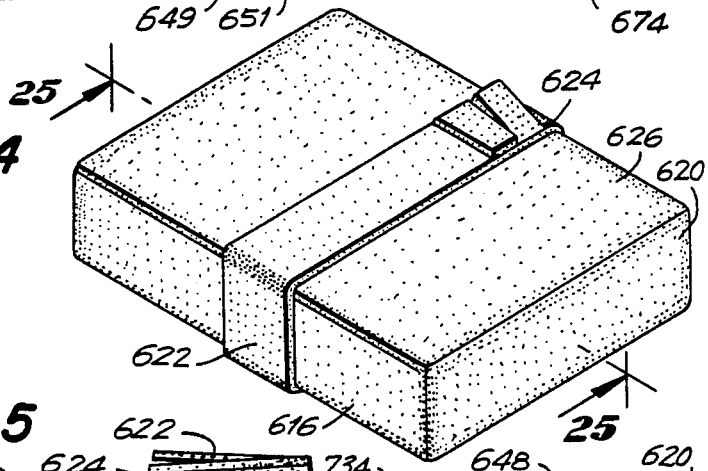
FIG. 25
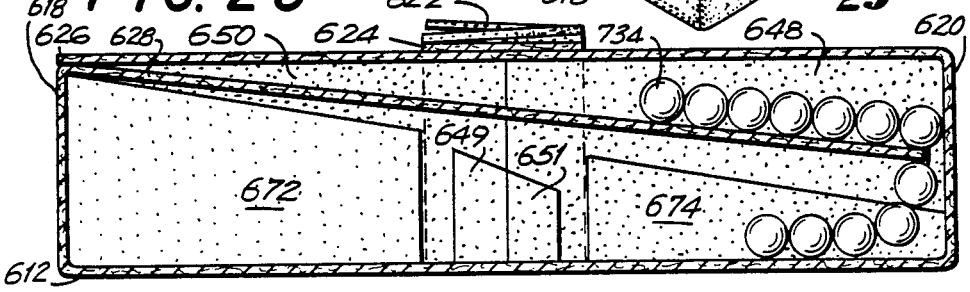

JEWELRY DISPLAY AND PACKAGING BOX AND BLANK THEREFOR

BACKGROUND OF THE INVENTION

This invention relates generally to display and packaging boxes, and more particularly, is directed to a compact box which can be used for displaying jewelry when configured one way and for packaging such jewelry at the point of sale when configured differently.

Devices for displaying jewelry items, such as earrings, watches, rings, necklaces and the like are well known. For example, in one form, as disclosed in U.S. Pat. No. 4,432,456, the device includes an open grid frame and a plurality of domed jewelry pads removably retained within the frame. Mounting means are located on the display pads for securing jewelry items thereto. However, after the jewelry items are sold, they must be removed from the display pads and packaged in a separate box. This becomes wasteful from a number of viewpoints. First, two separate items are necessary to display and package the jewelry items, that is, the display pads are used for displaying the jewelry items and separate boxes are used for packaging the jewelry items at the point of sale.

Another device is a pre-formed rigid box having a base and a cover hinged thereto. The jewelry item is held generally on a projection which forms part of the base. When the cover is opened, the jewelry item can be displayed, and when closed, the jewelry item is secure in the box and can be given to the customer at the point of sale. This box, however, also presents numerous disadvantages. First, the box is relatively expensive to manufacture so as to add unnecessarily to the cost of the jewelry item. Second, when the cover is opened, it blocks other jewelry items immediately behind the opened box, thereby requiring additional space. Third, because the box is pre-formed and rigid, it occupies much space during shipping, thereby further adding to the costs.

Jewelry packaging boxes are also known which are formed from a bottom wall, and four top flaps secured to the bottom wall, the four top flaps being bent to form the side walls of the boxes. Two opposing ones of the top flaps having securing means thereon, such as a snap arrangement, by which such top flaps can be secured together so that the device can be closed. The other top flaps are bent so as to be positioned below the secured top flaps when the latter are snapped together. These jewelry boxes, however, are not used for display purposes. Rather, the jewelry item is merely placed in the box and the top flaps are snapped together as aformentioned at the point of sale. In this regard, it is noted that when the two securing top flaps are not snapped together, the box falls apart in a flat configuration since there is no means for maintaining the box-like configuration. As such, these boxes could not be used for display purposes.

OBJECTS AND SUMMARY OF THE INVENTION

Accordingly, it is an object of the present invention to provide a box that can be used for both displaying and subsequent packaging of jewelry items at the point of sale.

More particularly, it is an object of the present invention to provide such a box that is attractive for packaging at the point of sale or during display, and which is easy and economical to manufacture.

It is another object of the present invention to provide such a box in which one of the top flaps is used for holding the jewelry item during display and packaging.

It is still another object of the present invention to provide such a box in which the box is maintained in its box-like configuration when changing from the display configuration to the packaging configuration.

It is yet another object of the present invention to provide such a box in which two opposing top flaps are provided with a snap arrangement or are formed by straps having a hook arrangement, for securing the opposing top flaps together.

It is another object of the present invention to provide such a box in which the top display flap which holds the jewelry item is maintained by the box in an upwardly inclined position in the display configuration so as to clearly and easily display the jewelry item thereon.

It is a further object of the present invention to provide such a box which can be formed from a flat blank that can be economically shipped and stored in a minimum amount of space by storing and shipping the blanks when they are flat and not yet assembled into the box.

It is a still further object of the present invention to provide a blank for forming a box for displaying and packaging jewelry items of the aforementioned type.

It is a yet further object of the present invention to provide such a blank which is inexpensive to manufacture.

In accordance with an aspect of the present invention, a display and packaging box includes a bottom wall; first and second end walls extending upward from the bottom wall and defining with the bottom wall an upwardly open container, each end wall having an upper edge; a cover flap pivotally connected to one of the upper edges for movement between a closed position in covering relation to the open container and an open position to permit access to the open container; a display flap pivotally connected to the other of the upper edges for movement between a display position extending above the cover flap when the latter is in the closed position and a packaging position between the bottom wall and the cover flap; the display flap including mounting means for securely mounting an object thereto such that the object is displayed when the display flap is in the display position and is safely contained in the box when the display flap is in the packaging position; maintaining means for maintaining the display flap in the display position; and securing flap means connected to the bottom wall for releasably locking the cover flap in the closed position when the display flap is in the packaging position so as to package the object in the box for transport and for releasably locking the cover flap in the closed position when the display flap is in the display position to display the object.

In accordance with another aspect of the present invention, a blank for forming a display and packaging box includes a bottom panel; first and second end panels having frist edges integrally and pivotally formed at opposite edges of the bottom panel; first and second side walls integrally formed with the first and second end panels; a display top flap integrally and pivotally connected to a second edge of the first end panel opposite the first edge thereof; a cover top panel integrally and pivotally connected to a second edge of the second end panel opposite the first edge thereof; and securing top flaps integrally and pivotally connected with the bottom wall.

The above and other objects, features and advantages of the present invention will become readily apparent from the following detailed description which is to be read in connection with the accompanying drawings.

BRIEF DESCRIPTION OF THE DRAWINGS

FIG. 1 is an inside plan view of a blank for forming a jewelry display and packaging box, according to a first embodiment of the present invention;

FIG. 2 is a perspective view of a jewelry display and packaging box formed by the blank of FIG. 1, in its display configuration;

FIG. 3 is a cross-sectional view of the box of FIG. 2, taken along line 3—3 thereof;

FIG. 4 is a perspective view of the box of FIG. 2, with the top straps not secured together and with the side flaps maintaining the box-like configuration, to show an intermediate step of changing over from the display configuration to the packaging configuration;

FIG. 5 is a perspective view of the box of FIG. 2 in its packaging configuration;

FIG. 6 is a cross-sectional view of the box of FIG. 5, taken along line 6—6 thereof;

FIG. 7 is an inside plan view of a blank for forming a jewelry display and packaging box, according to a second embodiment of the present invention;

FIG. 8 is a perspective view of a jewelry display and packaging box formed by the blank of FIG. 7, in its display configuration;

FIG. 9 is a cross-sectional view of the box of FIG. 8, taken along line 9—9 thereof;

FIG. 10 is a perspective view of the box of FIG. 8, with the top straps not secured together and with the side flaps maintaining the box-like configuration, to show an intermediate step of changing over from the display configuration to the packaging configuration;

FIG. 11 is a perspective view of the box of FIG. 8 in its packaging configuration;

FIG. 12 is a cross-sectional view of the box of FIG. 11, taken along line 12—12 thereof;

FIG. 20 is an inside plan view of a blank for forming a jewelry display and packaging box, according to a fourth embodiment of the present invention;

FIG. 21 is a perspective view of a jewelry display and packaging box formed by the blank of FIG. 20, in its display configuration;

FIG. 22 is a cross-sectional view of the box of FIG. 21, taken along line 22–22 thereof;

FIG. 23 is a perspective view of the box of FIG. 21, with the top flaps not secured together and with the side flaps maintaining the box-like configuration, to show an intermediate step of changing over from the display configuration to the packaging configuration;

FIG. 24 is a perspective view of the box of FIG. 21 in its packaging configuration;

FIG. 25 is a cross-sectional view of the box of FIG. 24, taken along line 25—25 thereof.

DETAILED DESCRIPTION OF THE PREFERRED EMBODIMENTS

Figure 13:
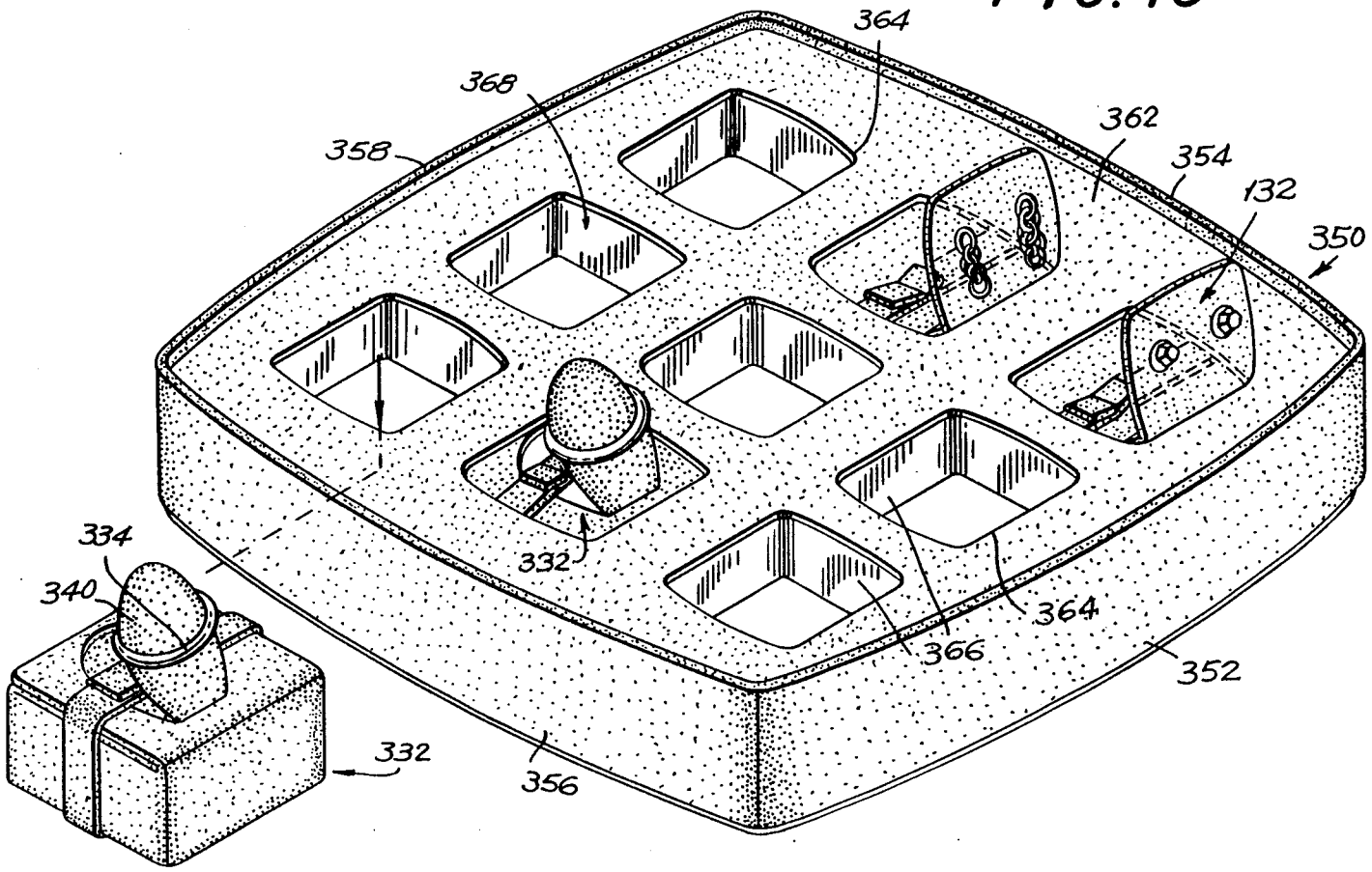
FIG. 13 is a perspective view of a display and packaging tray for holding a plurality of boxes according to the present invention.
Figure 14:
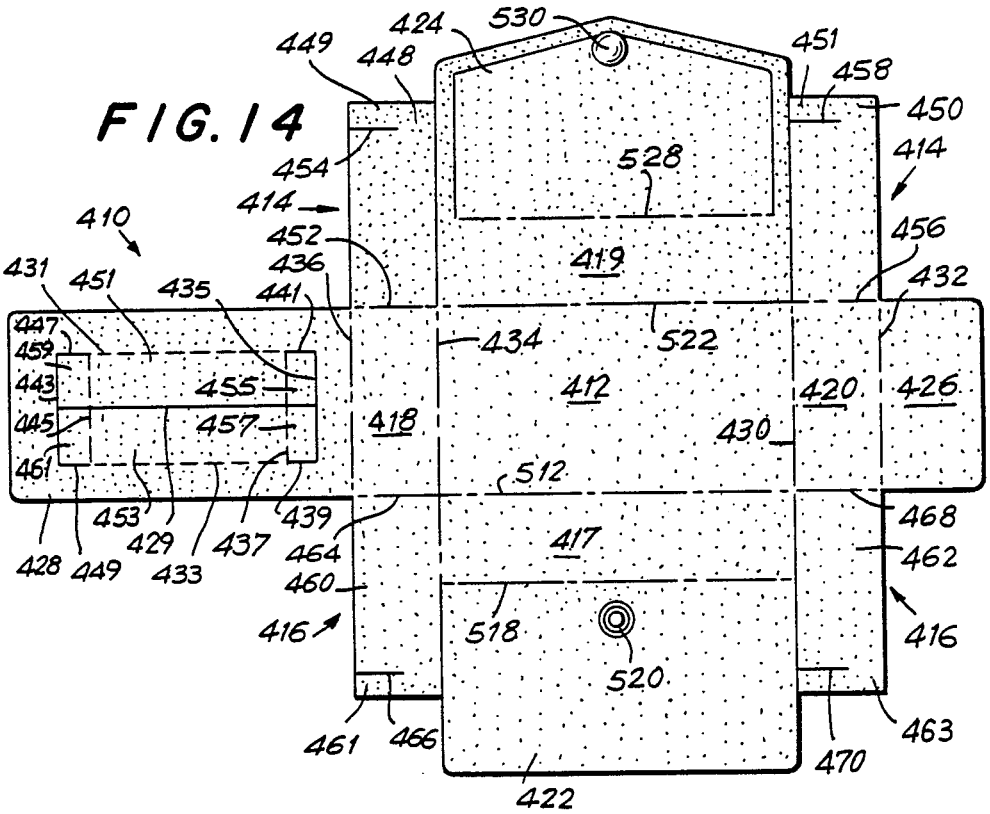
FIG. 14 is an outside plan view of a blank for forming a jewelry display and packaging box, according to a third embodiment of the present invention.

Referring to the drawings in detail, and initially to FIG. 1 thereof, a sheet blank 10 is provided with appropriate score lines such that when folded in the appropriate manner, an integral jewelry display and packaging box according to a first embodiment of the present invention is formed with a bottom wall or panel 12, opposite side walls 14 and 16, opposite end walls or panels 18 and 20 and first through fourth top flaps 22, 24, 26 and 28, respectively. Fourth top flap 28 is intended to hold a jewelry item thereon, which in this embodiment, is a pair of earrings. Bottom panel 12 in this first embodiment has a generally square configuration. Integral with bottom panel 12 is end panel 20 having an equal dimension to bottom panel 12 at the junction thereof, the joining line constituting a working score line 30. Third top flap 26 is integrally attached at a junction line constituting a working score line 32 to the side of end panel 20 opposite working score line 30. Third top flap 26 generally has the same dimensions as bottom panel 12.

End panel 18 is integrally attached to bottom panel 12 opposite the side constituting working score line 30. End panel 18 is of a generally rectangular configuration with the same dimensions as end panel 20, and is joined at a side of bottom panel 12 constituting a working score line 34. End panel 18 has the same dimension at working score line 34 as the same side of bottom panel 12. Fourth top flap 28 is integrally attached to back panel 18 at a joining line constituting a working score line 36 at the side of back panel 18 opposite working score 34. From working score line 36, the sides 38 of fourth top flap 28 flare inwardly a small distance in a tapered manner as indicated at 38, up to another working score line 40. From there, the side edges 42 extend at a substantially right angle to working score lines 36 and 40 and are bowed slightly outwardly and terminate in an edge 44 which is substantially parallel to working score lines 36 and 40. In this manner, fourth top flap 28 has a generally square configuration. Two holes 46 are also formed in fourth top flap 28 to permit earrings to be secured thereon, as will be described hereinafter.

Side wall 14 is formed by two side flaps 48 and 50. Side flap 48 has a substantially rectangular configuration with a shorter end thereof connected to one shorter end of end panel 20 at a joining line constituting a working score line 52. The opposite end 49 of side flap 48 is formed with a locking slit 54 as a hook means. In like manner, side flap 50 has a substantially rectangular configuration with a shorter end thereof connected to one shorter end of end panel 18 at a joining line constituting a working score line 56. The opposite end 51 of side flap 50 is formed with a locking slit 58 as a hook means. As will be made apparent from the discussion which follows, when sheet blank 10 is folded into a box-like configuration, slits 54 and 58 engage with each other to maintain the box-like configuration for both display and packaging of the jewelry item.

In the same manner, side wall 16 is formed by two side flaps 60 and 62. Side flap 60 has a substantially rectangular configuration with a shorter end thereof connected to the opposite shorter end of end panel 20 at a joining line constituting a working score line 64. The opposite end 61 of side flap 60 is formed with a locking slit 66 as a hook means. In like manner, side flap 62 has a substantially rectangular configuration with a shorter end thereof connected to the opposite end shorter end of end panel 18 at a joining line constituting a working score line 68. The opposite end 63 of side flap 62 is formed with a locking slit 70 as a hook means. Thus, in the same manner as slits 54 and 58, when sheet blank 10 is folded into a box-like configuration, slits 66 and 70 engage with each other to maintain the box-like configuration for both display and packaging of the jewelry item.

In addition, side wall 14 includes side tabs 72 and 74 connected to a side edge 75 of bottom panel 12 which is perpendicular to working score line 34 and parellel to working score line 52. Specifically, side tab 72 has a substantially trapezoidal configuration, with the two parallel edges 76 and 78 being parallel to working score line 34, and such that edge 76 is immediately adjacent to or abutting with a side edge 80 of side flap 50. A third edge of side tab 72 is perpendicular to edges 76 and 78 and is connected to side edge 75 of bottom panel 12 at a joining line constituing a working score line 82. Side tab 74 also has a substantially trapezoidal configuration, with the two parellel edges 84 and 86 also being parallel to working score line 34, and such that edge 86 is immediately adjacent to or abutting with a side edge 88 of side flap 48. A third edge of side tab 74 is perpendicular to edges 84 and 86 and is connected to the opposite end of side edge 75 of bottom panel 12 at a joining line constituting a working score line 90.

In like manner, side wall 16 includes side tabs 92 and 94 connected to the opposite side edge 95 of bottom panel 12 which is perpendicular to working score line 34 and parallel to working score line 64. Specifically, side tab 92 has a substantially trapezoidal configuration, with the two parallel edges 96 and 98 being parallel to working score line 34, and such that edge 96 is immediately adjacent to or abutting with a side edge 100 of side flap 62. A third edge of side tab 92 is perpendicular to edges 96 and 98 and is connected to side edge 95 of bottom panel 12 at a joining line constituting a working score line 102. Side tab 94 also has a substantially trapezoidal configuration, with the two parallel edges 104 and 106 also being parallel to working score line 34, and such that edge 106 is immediately adjacent to or abutting with a side edge 108 of side flap 60. A third edge of side tab 94 is perpendicular to edges 104 and 106 and is connected to the opposite end of side edge 95 of bottom panel 12 at a joining line constituting a working score line 110.

Top flaps 22 and 24 are formed as substantially rectangular strap-like members. One shorter edge of top flap 22 is integrally formed with side edge 95 of bottom panel 12 at a joining line which constituted a working score line 112, the latter being positioned between working score lines 102 and 110. In such position, side edges 114 and 116 of top flap 22 extend parallel to, and immediately adjacent to or in abutting relation with, side edges 98 and 104 of side tabs 92 and 94, respectively. In addition, a working score line 18 is formed parallel to working score line 112 and extends approximately one-third of the way from working score line 112 to the opposite end of top flap 22, and specifically extends for a length equal to the width of end panels 18 and 20 which define the height of the box to be formed. Further, a V-shaped notch or slit 120 is formed at such opposite end of top flap 22, and constitutes a hook means.

In like manner, one shorter edge of top flap 24 is integrally formed with side edge 75 of bottom panel 12 at a joining line which constitutes a working score line 122, the latter being positioned between working score lines 82 and 90. In such position, side edges 124 and 126 of top flap 24 extend parallel to, and immediately adjacent to or in abutting relation with, side edges 78 and 84 of side tabs 72 and 74, respectively. In addition, a working score line 128 is formed parallel to working score line 122 and extends for a distance from working score line 122 which is equal to the height of the box to be formed. Further, a V-shaped notch or slit 130 is formed at such opposite end of top flap 24 and constitutes a hook means. In this manner, notches 120 and 130 engage with each other at the top of the box formed from blank 10 for arranging blank 10 in either a display configuration or a packaging configuration.

The above described sheet blank 10 can be formed from a backing piece of a thin cardboard-like material, plastic or other suitable material, that provides some stiffness thereto. Prefereably, for aesthetic purposes, the backing piece is covered by felt or flocking to provide a finished appearance and to provide a smooth, non-scratch surface. The flocking can be applied to the backing piece by any suitable means such as by an adhesive.

Referring now to FIGS. 2 and 3, there is shown the blank 10 of FIG. 1 folded so as to form a jewelry display and packaging box 132 acccording to a first embodiment of the present invention which is configured in its display orientation. To achieve this display configuration, side tabs 72, 74, 92 and 94 are bent upwardly along working score lines 82, 90, 102 and 110, respectively, so as to be substantially perpendicular to bottom panel 12. Then, end panels 18 and 20 are also bent upwardly about working score lines 34 and 30, respectively. Side flaps 48 and 50 are then bent inwardly toward each other about working score lines 52 and 56, respectively, but to the outside of side tabs 72 and 74, with slits 54 and 58 engaging with each other in a locking manner to form side wall 14. It is noted that the ends 49 and 51 are positioned between side tabs 72 and 74 and to the inside of the box. In like manner, side flaps 60 and 62 are bent inwardly toward each other about working score lines 64 and 68, but to the outside of side tabs 92 and 94, with slits 66 and 70 engaging with each other in a locking manner to form side wall 16. Again, ends 61 and 63 are formed between side tabs 92 and 94 and to the inside of the box. Accordingly, blank 10 is maintained in the box-like configuration.

Then, top flap 26 is bent into the box 132 about working score line 32, as shown in FIGS. 2 and 3. Thereafter, strap-like top flaps 22 and 24 are bent upwardly about working score lines 112 and 122, respectively, so that top flaps 22 and 24 lie against the outside of side walls 16 and 14, respectively. Top flaps 22 and 24 are then bent toward each other about working score lines 118 and 128, respectively, and the free ends thereof are secured together by engaging the V-shaped notches 120 and 130 with each other. Thus, top flap 26 is locked at the top of the box 132. In this manner, the display configuration shown in FIGS. 2 and 3 is formed. If desired, top flap 28 can also be bent slightly down toward top flap 26, about working score lines 36 and 40.

In this display configuration, a pair of earrings 134 can be secured in apertures 46 of top flap 28 for display, as shown in FIGS. 2 and 3. It is noted that the top display flap 28 is maintained in an upwardly angled position for display at the front of the box so that it does not interfere with viewing of jewelry items behind the box. This upwardly inclined position is maintained by reason of the fact that side flaps 48 and 50, and side flaps 60 and 62 are secured together, which holds end panel 18 in an upright or vertical configuration. However, it will be appreciated that this same effect can be achieved even is side flaps 48, 50 and 60, 62 are not secured together. In other words, if side flaps 48 and 50 merely approach each other, without contact, the closure and securement of top flaps 22 and 24 together will hold side flaps 48 and 50 within the formed box, and this will hold end panel 18 in the vertical or upright position. As a result, even without securement of side flaps 48, 50 and 60, 62 together, top display flap 28 will be held in the aforementioned vertical position for display.

To change display and packaging box 132 to the packaging configuration, strap-like top flaps 22 and 24 are disengaged from each other, and top flap 26 is bent upwardly about working score line 32, as shown in FIG. 4. Then, top flap 28 which contains the pair of earrings 134 is bent downwardly into box 132 about working score line 36 in the direction of arrow 136, and top flap 26 is then bent downwardly about working score line 32 immediately over top flap 28 in the direction of arrow 138. Strap-like top flaps 22 and 24 are then reattached, as aforementioned, over top flap 26 to lock top flaps 26 and 28 in such position. In this manner, earrings 134 are positioned within box 132, as shown in FIGS. 5 and 6, so that they are not in view.

Referring now to FIGS. 7–12, there is shown another embodiment of a blank 210 and jewelry display and packaging box 332 according to the present invention, in which elements similar to those described above with respect to the embodiment of FIGS. 1–6 are identified by the same reference numerals augmented by 200, and a detailed description thereof will be omitted herein for the sake of brevity.

Blank 210 differs from blank 10 by the fact that top flap 228 differs from top flap 28. The remainder of blank 210 is identical to blank 10. Specifically with top flap 228, a working score line corresponding to working score line 40 is eliminated. Also, side edges 242 are formed as straight edges, rather than being bowed. More importantly, an oval jewelry support section 340 is formed substantially centrally in top flap 228, and is secured thereto in a hinged manner at a joining line constituting a working score line 342 which is parallel to and adjacent to working score line 236. This can be accomplished by cutting out support section 340 from top flap 228 along support section 340 except for working score line 342, as shown in FIGS. 712, to form an aperture therein. Two V-shaped cuts 344 are formed at the side edges of support section 340 for supporting a ring 334 around support section 340.

The assembly of blank 210 into box 332 in its display configuration is also slightly different. Specifically, when in the display configuration, top flap 228 is positioned immediately over top flap 226, and both top flaps 226 and 228 are positioned under the secured strap-like top flaps 222 and 224. However, support section 340 is pivoted upwardly about working score line 342, as shown in FIG. 8, to display the ring 334. In all other respects, box 332 is identical to box 132.

Conventionally, when displaying a ring, a round projecting finger is provided on which the ring is disposed. With the embodiment of FIGS. 7–12, when the ring 334 is positioned around support section 340, it bends support section 340, as shown in FIG. 8 into an arcuate configuration which simulates the aforementioned round projecting finger, and thereby provides an aesthetically pleasing visual display of the ring 334.

Referring now to FIG. 13, there is shown a display and storage tray 350 for holding a plurality of boxes 132 and 332 according to the present invention. Specifically, tray 350 is formed of a generally square configuration with surrounding side walls 352, 354, 356 and 358, each having a height at least equal to the height of the jewelry display and packaging boxes 132 and 332 which are to be held thereby, a bottom wall (not shown) and a top wall 362, all of which may have suitable flocking or the like thereon to enhance the appearance of tray 350. A plurality of apertures 364 are cut in top wall 362 and the bottom wall, and intermediate side walls 366 extend downwardly from top wall 362 to the bottom wall, in apertures 364, to define box receiving receptacles 368, as shown.

Thus, the jewelry display and packaging boxes 132 and 332 can be positioned within receptacles 368 for display purposes, as shown. Specifically, boxes 132 and 332 are pushed upwardly through the bottom wall so that the open ends thereof face top wall 362. When a jewelry item is sold, the respective box 132, 332 is pushed out through the bottom wall, from the top, and the boxes are are changed over to their packaging configurations, as shown in FIGS. 5 and 11, and given to the customer. Accordingly, the box provides an attractive package for the jewelry item when it is sold. There is thus no need to provide a separate package therefor.

Referring now to FIGS. 14–19, there is shown another embodiment of a blank 410 and jewelry display and packaging box 352 according to the present invention, in which elements similar to those described with respect to the embodiment of FIGS. 1–6 are identified by the same reference numerals augmented by 400, and a detailed description thereof will be omitted herein for the sake of brevity.

Figure 15:
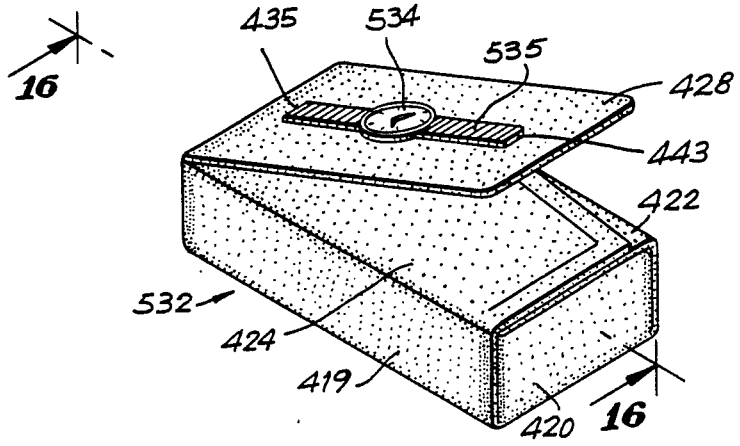
FIG. 15 is a perspective view of a jewelry display and packaging box formed by the blank of FIG. 14, in its display configuration.
Figures 16, 17, 18, 19:
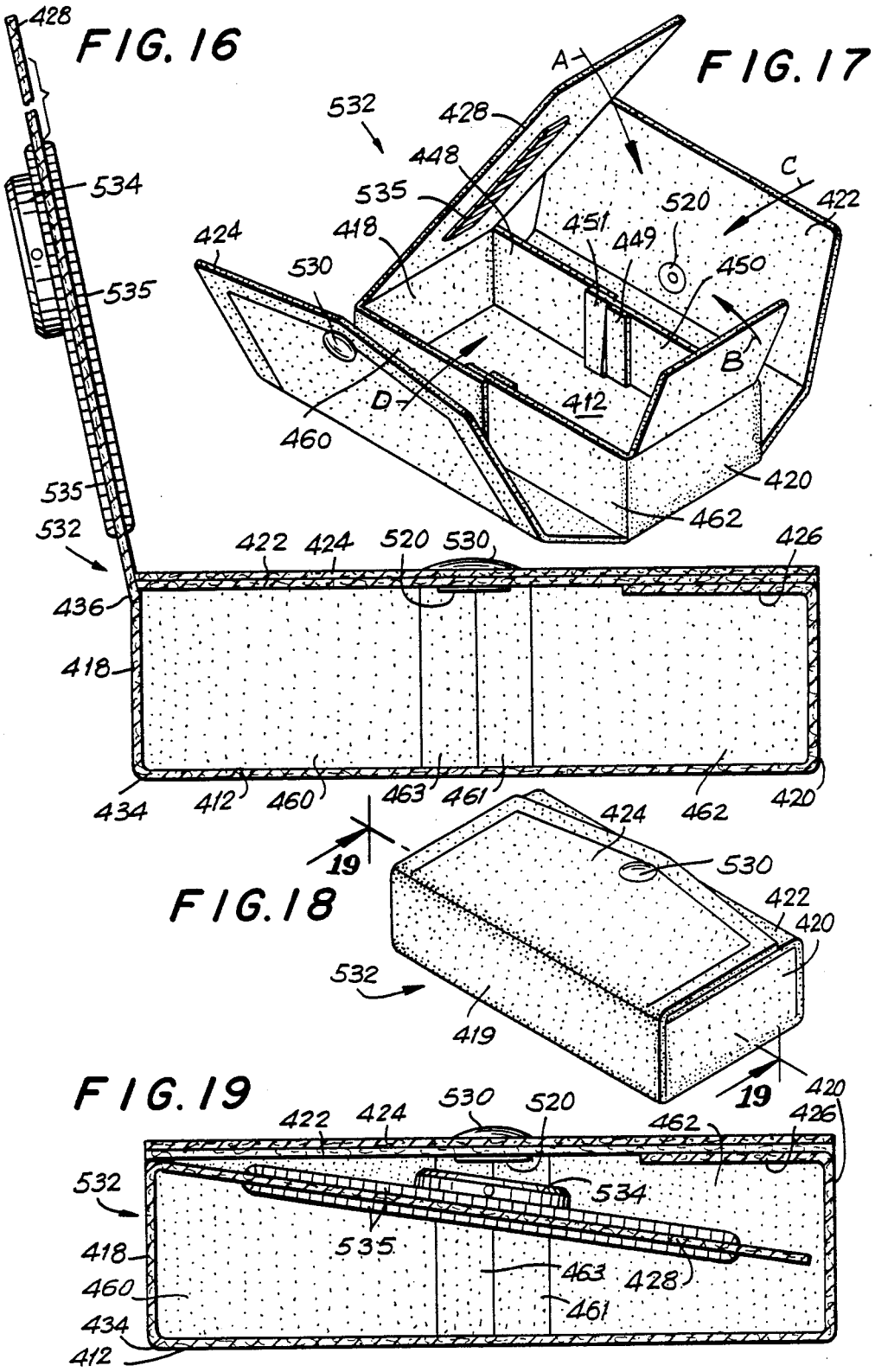
FIG. 16 is a cross-sectional view of the box of FIG. 15, taken along line 16—16 thereof.
FIG. 17 is a perspective view of the box of FIG. 15, with the top flaps not secured together and with the side flaps maintaining the box-like configuration, to show an intermediate step of changing over from the display configuration to the packaging configuration.
FIG. 18 is a perspective view of the box of FIG. 15 in its packaging configuration.
FIG. 19 is a cross-sectional view of the box of FIG. 18, taken along line 19—19 thereof.

Blank 410 differs from blank 10 by the fact that top flaps 442 and 424 are formed as full panels, rather than strap-like members. Top flaps 422 includes a male snap element 520 and top flap 424 includes a female snap element 530 which mates with male snap element 520, as shown in FIGS. 15 and 18. Further, top flaps 422 and 424 are integrally formed with further end panels 417 and 419 about joining lines constituting working score lines 518 and 528, respectively, and end panels 417 and 419 are integrally formed to opposite edges of bottom panel 412 about joining lines constituting working score lines 512 and 522, respectively. However, as with the embodiments of FIGS. 1–6 and 7–12, it is side flaps 448, 450, 460 and 462 that maintain blank 410 in its box-like configuration, and which present the flap 428 in the upwardly inclined position for display.

With the embodiment of FIGS. 15 and 16, jewelry containing top flap 428 is intended to carry a watch 534 having a continuous watchband 535 or other loop-like jewelry item, as shown in FIG. 15, for display purposes. In this regard, top flap 428 is formed with a longitudinal center slit 429, and two working score lines 431 and 433 parallel and adjacent thereto on opposite sides, as shown. A slit 435 is formed at one end of slit 429. Slit 435 is centered with respect to slit 429 and is perpendicular thereto. A working score line 437 is formed inwardly of slit 435 and parellel thereto, and the respective ends of working score lines 431 and 433 which connect the ends of working score line 437 and slit 435, form slits 439 and 441. In like manner, a slit 443 is formed at the opposite end of slit 429. Slit 443 is centered with respect to slit 429 and is perpendicular thereto. A working score line 445 is formed inwardly of slit 443 and parallel thereto, and the opposite ends of working score lines 431 and 433 which connect the ends of working score line 445 and slit 443. form slits 447 and 449. Accordingly, two longitudinal foldable sections 451 and 453 are formed which can be bent about working score lines 431 and 433, respectively, to position watchband 535 therein. In addition, foldable sections 455, 457, 459 and 461 are formed at the ends of foldable sections 451 and 453 and which can be bent about working score lines 437 and 445, to aid in the positioning of watchband 535 therein, as shown in FIG. 15.

Further, jewelry display and packaging box 532 is changed from its display configuration of FIGS. 15 and 16 to its packaging configuration shown in FIGS. 18 and 19 by unsnapping snaps 520 and 530 and opening up the top flaps thereof, and then closing and securing the top flaps in the order shown by arrows A–D.

Referring not to FIGS. 20–25, there is shown another embodiment of a blank 610 and jewelry display and packaging box 732 according to the present invention, in which elements similar to those described with respect to the embodiment of FIGS. 1–6 are identified by the same reference numerals augmented by 600, and a detailed description thereof will be omitted herein for the sake of brevity.

Blank 610 differs from blank 10 by the fact that top flap 628 is intended to hold a string of pearls 734, a necklace or the like therearound. Specifically, as shown in FIG. 20, top flap 628 includes two angled slits 629 and 631 at the free corner thereof. The string of pearls 734 is inserted in slits 629 and 631, and hangs freely down therefrom for display. At the rear of top flap 628, the excess length of a long string of pearls 734 is positioned within the box.

Figure 26:
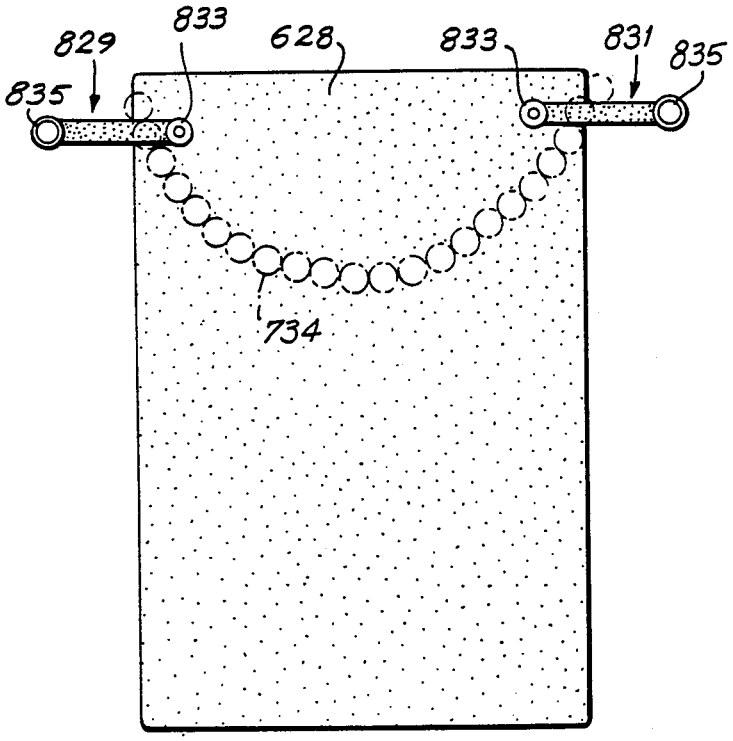
FIG. 26 is a plan view of the rear of a display top flap that can alternatively be used in the embodiment of FIG. 21.

Alternatively, as shown in FIG. 26, securing straps 829 and 831 can be used in place of slits 629 and 631 at the free corners of top flap 628. Each securing strap has one end secured to a free corner of top flap 628 by means of a female snap 833, and the opposite end of each strap has a male snap 835 secured thereto. Thus, the string of pearls 734 can be positioned as shown in phantom. Then, each male snap 835 can be secured to the respective female snap 833 to secure the pearls in such position.

With all of the above embodiments, the blanks are maintained in their box-like configurations by side walls 14, 16; 214, 216; 414, 416; and 614, 616, when changing between the display and packaging configurations. With the boxes according to the present invention, the boxes can be used for display and then point of sale packaging. Since the boxes according to the present invention are formed from blanks, large amounts of blanks can be stored and shipped in a small space.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A display and packaging box comprising:

a bottom wall;

first and second end walls extending upward from the bottom wall and defining with the bottom wall an upwardly open container, each end wall having an upper edge;

a cover flap pivotally connected to one of the upper edges for movement between a closed position in covering relation to the open container and an open position to permit access to the open container;

a display flap pivotally connected to the other of the upper edges for movement between a display position extending above the cover flap when the latter is in the closed position and a packaging position between the bottom wall and the cover flap;

said display flap including mounting means for securely mounting an object thereto such that said object is displayed when said display flap is in said display position and is safely contained in the box when said display flap is in said packaging position;

maintaining means for maintaining said display flap in said display position; and securing flap means connected to said bottom wall for releasably locking said cover flap in said closed position when said display flap is in said packaging position so as to package said object in said box for transport and for releasably locking said cover flap in said closed position when said display flap is in said display position to display said object.

2. A display and packaging box according to claim 1; wherein said maintaining means includes first and second side walls integrally formed with said first and second end walls and extending substantially perpendicular to said first and second end walls and to said bottom wall;

said first side wall including a first side flap with a first edge pivotally connected with a first side edge of said first end wall and a second side flap with a first edge pivotally connected with a second opposite side edge of said second end wall;

said second side wall including a third side flap with a first edge pivotally connected with a first side edge of said second end wall and a fourth side flap with a first edge pivotally connected with a second opposite side edge of said second end wall; and said securing flap means also holding said first through fourth side flaps in said open container.

3. A display and packaging box according to claim 2; wherein said first, second, third and fourth side flaps having second free edges opposite said first edges thereof, with hook means adjacent said second free edges thereof for securing said first through fourth side flaps together;

said second free edges of said first and second side flaps being secured together by said hook means thereof, and said second free edges of said third and fourth side flaps being secured together by said hook means thereof, so as to form and maintain said box in a box-like configuration regardless of the arrangement thereof for display and packaging, and when changing between said display and packaging arrangements.

4. A display and packaging box according to claim 1; wherein said securing flap means includes first and second top flaps secured to said bottom wall and formed as strap-like members.

5. A display and packaging box according to claim 4; wherein free ends of said strap-like top flaps have notches therein for securing the free ends of said first and second top flaps together.

6. A display and packaging box according to claim 1; wherein said first and second top flaps have snap means for engaging with each other to secure said first and second top flaps together.

7. A display and packaging box according to claim 1; wherein said display flap has at least one aperture therein for receiving and holding a pair of earrings thereon.

8. A display and packaging box according to claim 1; wherein said display flap has support means hingedly connected therewith for carrying a ring therearound.

9. A display and packaging box according to claim 1; wherein said display flap has at least one slit therein for carrying a watch thereon.

10. A display and packaging box according to claim 1; wherein said display flap has two notches therein for carrying a jewelry string thereon.

11. A display and packaging box according to claim 1; wherein said display flap has securing strap means for carrying a jewelry string thereon.

12. A blank for forming a display and packaging box, said blank comprising:

a bottom panel;

first and second end panels having first edges integrally and pivotally formed at opposite edges of said bottom panel;

first and second side walls integrally formed with said first and second end panels;

a display top flap integrally and pivotally connected to a second edge of said first end panel opposite said first edge thereof;

a cover top panel integrally and pivotally connected to a second edge of said second end panel opposite said first edge thereof; and securing top flaps integrally and pivotally connected with said bottom wall.

13. A blank according to claim 12; wherein said first side wall includes a first side flap with a first edge integrally formed with a first side edge of said first end panel and a second side flap with a first edge integrally formed with a first side edge of said second end panel;

said second side wall includes a third side flap with a first edge integrally formed with a second opposite side edge of said first end panel and a fourth side flap with a first edge integrally formed with a second opposite side edge of said second end panel.

14. A blank according to claim 13; wherein said first, second, third and fourth side flaps have second free edges opposite said first edges thereof, with hook means adjacent said second free edges thereof for securing said first and second side flaps together and for securing said third and fourth side flaps together, so as to form and maintain said blank in a box-like configuration regardless of the arrangement thereof for display and packaging, and when changing between said display and packaging arrangements.

15. A blank according toe claim 12; wherein said securing top flaps include first and second securing top flaps secured to said bottom wall.

16. A blank according to claim 15; wherein said first and second securing top flaps are formed as strap-like members, and free ends of said first and second strap-like securing top flaps have notches therein for securing the free ends of said first and second securing top flaps together.

17. A blank according to claim 15; wherein said first and second securing top flaps have snap means for engaging with each other to secure said first and second securing top flaps together.

18. A blank according to claim 12; wherein said display flap has at least one aperture therein for receiving and holding a pair of earrings thereon.

19. A blank according to claim 12; wherein said display flap has support means hingedly connected therewith for carrying a ring therearound.

20. A blank according to claim 12; wherein said display flap has at least one slit therein for carrying a watch thereon.

21. A blank according to claim 12; wherein said display flap has two notches therein for carrying a jewelry string thereon.

22. A display and packaging box according to claim 12; wherein said display flap has securing strap means for carrying a jewelry string thereon.

* * * * *